United States Patent [19]

Scarselletta

[11] Patent Number: 4,693,307

[45] Date of Patent: Sep. 15, 1987

[54] TUBE AND FIN HEAT EXCHANGER WITH HYBRID HEAT TRANSFER FIN ARRANGEMENT

[75] Inventor: Louis Scarselletta, Lockport, N.Y.

[73] Assignee: General Motors Corporation, Detroit, Mich.

[21] Appl. No.: 912,575

[22] Filed: Sep. 29, 1986

Related U.S. Application Data

[63] Continuation-in-part of Ser. No. 776,419, Sep. 16, 1985, abandoned, which is a continuation of Ser. No. 642,100, Aug. 20, 1984, abandoned.

[51] Int. Cl.[4] ..... F28D 1/02

[52] U.S. Cl. ..... 165/152; 165/153

[58] Field of Search ..... 165/152, 153

[56] References Cited

U.S. PATENT DOCUMENTS

| | | | |
|---|---|---|---|
| 3,003,749 | 10/1961 | Morse | 165/152 |
| 3,521,707 | 7/1970 | Brown | 165/152 |
| 3,993,125 | 11/1976 | Rhodes | 165/153 |

*Primary Examiner*—Albert W. Davis, Jr.
*Assistant Examiner*—Peggy A. Neil
*Attorney, Agent, or Firm*—R. L. Phillips

[57] ABSTRACT

A motor vehicle tube and fin heat exchanger is disclosed comprising a plurality of tubes arranged in spaced side-by-side relationship and a plurality of louvered fins arranged in spaced side-by-side relationship and between and in heat transfer relationship with adjacent ones of the tubes. The fins preferably have a thickness and stacked density such as to constitute not more than 12% nor less than 2.5% of the space between the adjacent tubes, a total louvered area not more than 60% nor less the 40% of the total fin area, and a linear fin edge projection density of not more than 1.2 $mm^{-1}$ nor less than 0.68 $mm^{-1}$.

3 Claims, 20 Drawing Figures

TUBE AND FIN HEAT EXCHANGER WITH HYBRID HEAT TRANSFER FIN ARRANGEMENT

TECHNICAL FIELD

This application is a continuation-in-part of application Ser. No. 776,419, filed Sept. 16, 1985 which is a continuation of application Ser. No. 642,100, filed Aug. 20, 1984 now abandoned.

This invention relates to tube and fin heat exchangers and more particularly to louvered fin arrangements therefor.

BACKGROUND OF THE INVENTION

In flat tube and fin heat exchangers such as used as radiators in vehicle engine cooling systems, the design and geometry of the fin (also called air center) has progressed from a plain surface with arbitrary dimensions to various louver arrangements and dimensions tailored from experience to improve the heat transfer efficiency and thereby decrease the necessary core size. Illustrative of the various louvered fin designs that have evolved are those disclosed in U.S. Pat. Nos Modine 1,726,360; Saunders U.S. Pat. No. 2,063,757; Simpelaar U.S. Pat. No. 2,703,226; Simpelaar U.S. Pat. No. 2,789,797; Morse U.S. Pat. No. 3,003,749; Rhodes et al U.S. Pat. No. 3,250,325; Nickol et al U.S. Pat. No. 3,265,127; Przyborowski U.S. Pat. No. 3,298,432; Jentet U.S. Pat. No. 3,305,009; Brown U.S. Pat. No. 3,521,707; Rhodes 3,993,125; Verhaegle et al U.S. Pat. No. 4,311,193; Cheong et al U.S. Pat. No. 4,328,861 and Hiramatsu U.S. Pat. No. 4,332,293. Typically, compact heat exchangers utilize extended fin surface area to increase spatial efficiency with the heat transfer performance tending to be enhanced as the fin density (number of fins per unit length along the tubes) increases provided sufficient working fluid (air) mass flow rate is maintained across the extended fin surface. As seen in the above louvered fin designs, various arrangements of consecutive multiple louvers have been utilized to create turbulence in the working fluid; the theory being that such added turbulence increases the convection heat transfer coefficient resulting in increased heat transfer by insuring maximum temperature differential between the extended surface and the working fluid (air). Although the louvers do increase the heat transfer performance of an extended surface fin at a constant air mass flow rate, such increase is typically gained at the expense of air pressure drop.

Various louver spacing, louver angle and fin density combinations give different trade off relationships but it has been found that certain identifiable important trends do evolve whose positive attributes can best be utilized as disclosed later in the present invention by not simply adding more louvers or altering their geometry within a pressure drop constraint as has been the normal practice. As to such trends, it has been found for example that at constant air mass flow, the heat rejection increases with fin density if the internal geometry (i.e. that of the louvers) remains unchanged. Furthermore, the heat transfer actually becomes less sensitive to louver angle as the fin density increases. On the other hand, the air side pressure drop and therefore the air flow rate becomes more sensitive to louver angle as the fin density increases. Moreover, both the heat transfer and the air side pressure drop become more significant as core depth increases along with the fin density. However, increase in core depth can be avoided with increased fin density but then the louvers must be specially tailored to avoid excessive air side pressure drop. And then there are also vehicle performance factors to consider related to radiator performance. For example, the air side pressure drop limitations may be determined by whether an electric fan or an engine driven fan forces the air flow past the fins in the radiator combined with vehicle ram air effectiveness and functional interrelationships between engine heat rejection and vehicle operating condition. Then there are the affects of air flow variations on air conditioning system performance as well as the variance in engine cooling requirements between diesel and gasoline engines. In addition, there are various manufacturing considerations such as the sensitivity of louver formation and thus performance to tool settings, fin handling and core stacking and their attendant costs, flux/degreaser entrapment and fin resistance to crushing along with column strength to prevent ballooning of the flat tubes from internal pressure.

SUMMARY OF THE INVENTION

The present invention runs counter to accepted practice in providing a unique but simple geometrical solution to the air side pressure drop problem following on the discovery of certain critical or controlling parameters. As will be shown in various embodiments, with a relatively few strategically located louvers and a prescribed fin density the advantages of both multilouver and plain fin designs are effectively combined so as to substantially reduce the air side pressure drop from the current conventional multilouver-caused level but without a significant reduction in the constant mass flow heat transfer performance. This new fin design, because it combines the advantages of both a multilouver fin and a plain fin, will be referred to as a "hybrid" fin or air center.

In the making of this invention, flat tube and fin radiators with the early conventional plain fins (without louvers) were tested and it was found that encouraging but less than adequate heat transfer performance occurred at low (less than typical) air mass flow rates when compared to equivalent size radiators with the current conventional multilouver fins (louvers over most of the fin area) and higher fin densities (e.g. greater than 14 fins per inch) found adequate for the typical encountered air flow rates of 60–90 pounds per minute per square foot of radiator frontal area. The approach taken in the present invention was to vary the internal geometry of the heat exchanger, i.e. the louvering versus plain surface of the fin, to reduce the associated air side pressure drop at a given rate of heat transfer and mass flow as compared to conventional multilouvered fins. In pursuit of this objective to alter the air flow restrictivity only, the inventor was cognizant that in heat transfer applications where the rate of fluid flow over an extended surface is sufficiently sensitive to the restrictivity of the heat exchanger, the overall heat exchanger performance can actually be reduced where the extended surface, i.e. that of the fins, is increased to a point where it adds excessive core restrictivity. And since the heat transfer mechanism between the extended surface and the working fluid (air) is essentially convective, the governing heat transfer equation is $$Q = hA\ T$$

where:

h=convective coefficient

A=total contact surface area

T=effective temperature difference between the working fluid and the extended surface.

A simple and effective method of increasing the heat exchange performance per unit core envelope volume is to increase the number of fins thereby increasing the fin density and the numerical value of A. The convective coefficient is a function of the flow characteristic over the fin surface where laminar flow provides a numerically lower value than turbulent flow. Further, a developed boundary layer tends to allow only conductive heat transfer through the working fluid due to the lack of effective mixing. To that end, louvered fin surfaces are developed to maximize T as well as h at a constant mass flow rate by providing mixing. This is effected by the boundary layer being temporarily "tripped" by the louvers to minimize development or stabilization but such tripping represents mechanical effort and contributes to pressure drop. The hybrid fin surface design according to the present invention acts in a synergistic way to reduce mechanical effort by strategically combining a minimum number of louvers with plain areas so as to provide a controlled pressure drop and thereby an air flow that enhances localized T by bathing the fin with generous amounts of low temperature air instead of relying upon aggressive mixing to redistribute low and high temperature air within the channel flow. To this end, the hybrid geometry intermittently trips the boundary layer and depends at least partially on the residual fluid disturbance to avoid a significant reduction in the convective heat transfer coefficient over the plain fin area. This initial concept through further investigation into the affect on pressure drop was then found to allow further increases in the fin density without substantial pressure drop penalties such as to maintain the necessary airflow in the restriction sensitive systems earlier identified. This combination of the hybrid fin and increased fin density was found to produce dramatic improvement in heat transfer and/or applied system performance in a certain window of critical or controlling parameters: namely when the hybrid fins were provided with a total louvered area not more than 60% nor less than 40% of the total fin area, a thickness and stacked density not more than 12% nor less than 2.5% of the space between the adjacent flat tubes, and a linear fin edge projection density in terms of fin pitch and span as later defined of not more than 1.2/mm nor less than 0.68/mm. In the resulting radiator structure, it was found that significantly improved or optimum heat transfer performance results occur in a system because of the higher mass flow rates allowed by the reduced restrictivity providing a substantially higher mean effective T since for a given heat transfer rate, the fluid temperature is less affected as the flow rate increases. That is, the fluid temperature gradient along the air flow path past the fin is then less severe allowing more of the extended fin surface area to be exposed to the fluid temperatures near the air source conditions. For example, with the typically encountered airflow rates of 60–90 pounds per minute per square foot, a tube and fin radiator constructed with the hybrid fin or air center having few but strategically placed louvers over the prescribed limited surface area and the prescribed fin density was shown to exhibit greatly reduced air side pressure drop without significant reduction in the constant mass flow heat transfer performance as compared to the best performing conventional multilouvered fins such as those disclosed in the above-identified patents.

Moreover, it was discovered that each of the fins could then further be provided with an integral beam extending thereacross between the adjacent tubes so as to strengthen the fins against crushing from external forces and in the case of flat tubes also strengthen same against ballooning from internal forces or pressure. The net result was a compact highly efficient tube and fin heat exchanger ideally suited for use as a radiator in a vehicle's engine cooling system wherein with the prescribed new hybrid fin design and fin density, the various vehicle performance factors and manufacturing considerations previously identified are effectively accounted for in a cost efficient manner.

Considering the application of the present invention to multiple tube row arrangements, i.e. two or more rows of tubes as compared to a single row application, it was found that the typical multi-louvered pattern of the fin between the rows of tubes acted in effect as a heat conductivity restriction. As a result, heat transferring to areas on the extended fin surface between successive tubes was then hindered by the louver interruptions in the conductive flow path. The hybrid fin design of the present invention, on the other hand, with its stragetic location of fewer louvers and extended plain areas between successive tubes provides an increased conductive flow path between the tubes and thereby effectively reduces the temperature gradient in the fin. This improves the heat transfer efficiency because more of the fin mass then approaches the base temperature effectively increasing the T between the extended fin surface and the working fluid (air).

Summarizing then the significant advantages of the hybrid fin arrangement of the present invention, it will be appreciated that this new design arrangement operates to maintain the performance of the heat exchanger in nonrestriction sensitive systems while increasing performance where the working fluid flow rate is restriction sensitive. Moreover, the hybrid fin makes it possible to increase the fin density substantially without a significant reduction in fluid flow for restriction sensitive systems while improving the effectiveness with which the extended fin surface is utilized and thereby increase the cooling capabilities within a given spatially constrained heat exchanger. For instance, the core content may then be reduced by increasing fin density to reduce core volume. On the other hand, within the same geometry, the hybrid fin concept acts to control restrictivity to an acceptable level while actually matching heat transfer characteristics of the more material intensive core. This unique combination also provides for improved manufacturability with less flux/degreaser entrapment and lower tooling costs with fewer cutting tools (typically discs). Furthermore, it will be appreciated that there is provided improved performance reliability with the reduction in the number of louvers because the fin's internal geometry variations such as louver angle have less of an affect on core performance. And particularly important with respect to the downsizing of cars, there is provided the capability of substantially reducing the core depth by replacing it with increased fin density where core face area is restricted and the airflow rate is particularly sensitive to pressure drop. Furthermore, the lower hood lines for improved aerodynamics leads to low aspect ratio radiators and resultantly lower fan area/core face ratios and therefore a need to increase ram air effectiveness as provided by the present invention to maximize the core utilization in those portions not covered by the fan and shroud.

These and other objects, features and advantages of the present invention will become more apparent from the following detailed description and accompanying drawings in which:

DESCRIPTION OF THE DRAWINGS

Referring to FIG. 1, there is shown a flat tube and fin crossflow radiator generally designated as 10 used in the engine cooling system of a motor vehicle. The radiator basically comprises a pair of vertically oriented tanks 12 and 14 interconnected by a horizontally oriented liquid-to-air heat exchanger core 16 of flat tube and fin construction. The tanks 12 and 14 have an inlet pipe 18 and outlet pipe 20, respectively, by which the radiator is connected in the cooling system with the tank 14 additionally having a fill pipe 22 and connected overflow pipe 24 by which the cooling system is filled and allowed to overflow, respectively.

Figure 2:
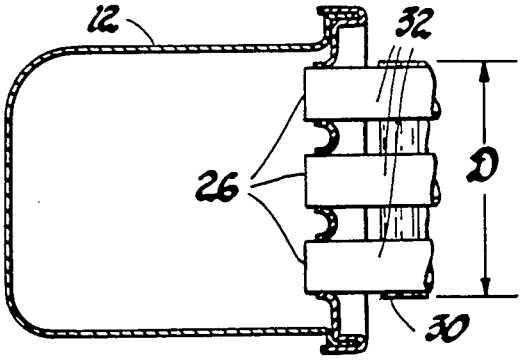
FIG. 2 is an enlarged sectional view taken along the line 2—2 in FIG. 1.
Figure 3:
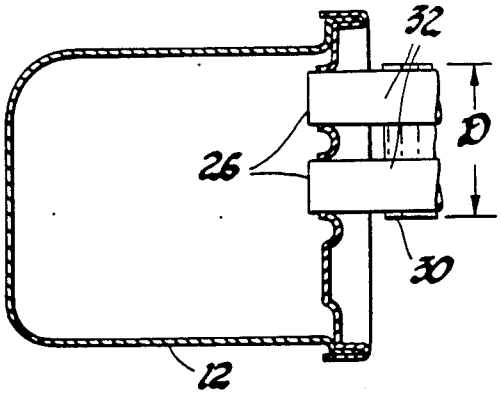
FIG. 3 is a view similar to FIG. 2 but showing the radiator having two rows of flat tubes and another embodiment of the hybrid fin arrangement of the present invention incorporated therewith.
Figure 4:
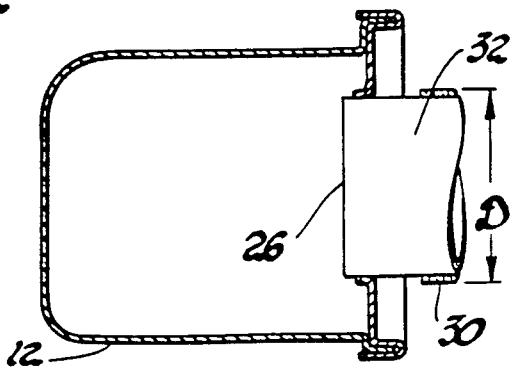
FIG. 4 is a view similar to FIG. 2 but showing the radiator with a single row of flat tubes and still another embodiment of the hybrid fin arrangement of the present invention incorporated therewith.

The core 16 comprises a plurality of flat tubes 26 interconnecting the tanks 12 and 14 for liquid flow therebetween from the radiator inlet pipe 18 located at the top of tank 12 to the radiator outlet pipe 20 located at the bottom of the other tank 14. The flat tubes 26 are arranged side-by-side in one or more rows across the width of the core with FIG. 2 showing a three-row arrangement, FIG. 3 showing a two-row arrangement and FIG. 4 showing a single row arrangement. In the multiple tube row arrangements; namely, the FIGS. 2 and 3 arrangements, the tubes in one row are also arranged to align with those in the other row(s) across the depth D of the core. Then for increased heat transfer performance, the core 16 is additionally provided with fins or air centers preferably formed by corrugated strips 30 singularly arranged between the opposed flat sides 32 of each adjacent set of tubes. The strips are bonded at their crests to the respective tubes for intimate heat transfer relationship therewith and are formed so as to define in the air space between each adjacent set of tubes a series or stack of distinct fins or air centers 34 extending between adjacent crests of the corrugations in each strip that are spaced side-by-side parallel to each other and at right angles to the tubes.

According to the present invention, just a few louvers 36 formed in each of the fins and strategically located relative to both their otherwise plain surface and to the flat tubes 26 defines what is called herein a hybrid form of fin or air center 34. It will be demonstrated that these hybrid fins 34 when combined with a certain prescribed fin density cooperate to produce substantially improved heat transfer performance by the core without the disadvantageous air pressure drop that normally accompanies an increase in density of conventional multilouver fins whose louvers extend over most of the fin area.

Figure 5:
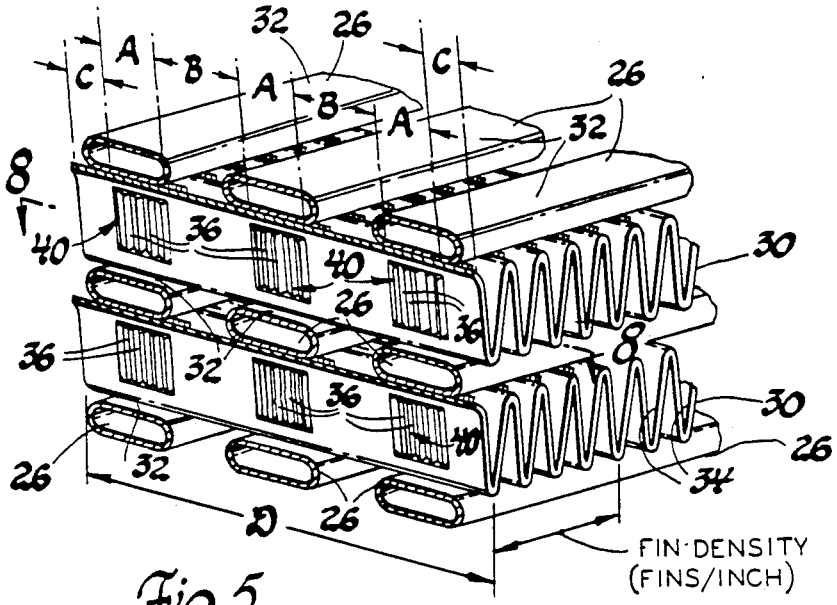
FIG. 5 is an enlarged isometric view of a section of the three-row tube radiator core in FIG. 1.
Figure 7:
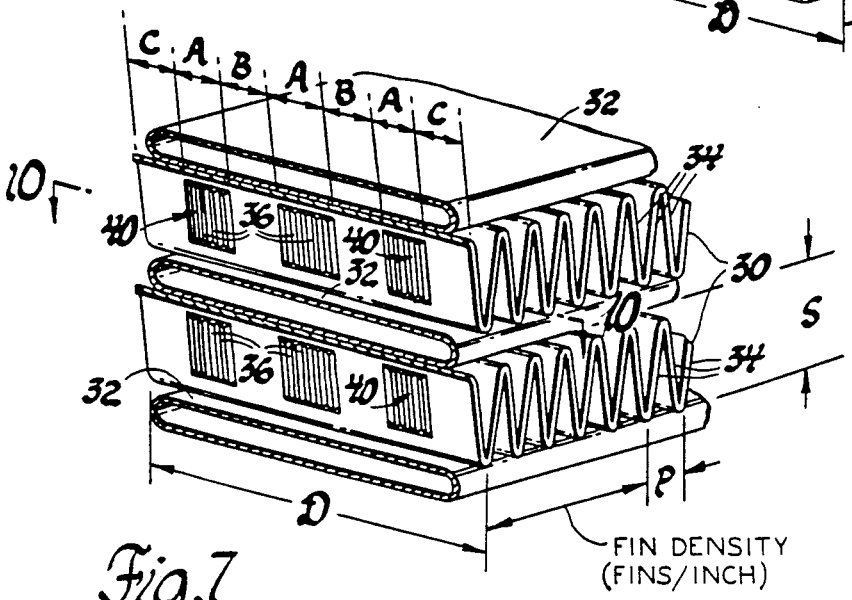
FIG. 7 is an enlarged isometric view of a section of the one row tube radiator core in FIG. 4.
Figure 8:
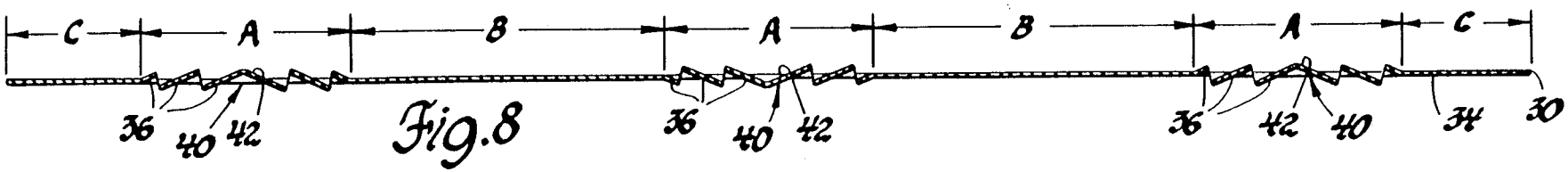
FIG. 8 is an enlarged longitudinal sectional view taken along the line 8—8 through one of the hybrid fins in FIG. 5.

Referring to FIGS. 2, 5 and 8, the hybrid fins 34 for the three-row tube core have three small groups 40 of the louvers 36 spaced longitudinally or along the length of each fin so that each group is directly between the opposed flat sides 32 of the tubes in each row. In similar manner, the hybrid fins 34 for the two-row tube core have two but larger groups 40 of louvers 36 with each such group located directly between the flat tubes (see FIGS. 3, 6 and 9). Then also in similar but extended manner, the hybrid fins 34 for the single row tube core have three small groups 40 of the louvers 36 located directly between the opposed flat-sided tubes to provide intermittent boundary layer interruptions in areas providing maximum heat transfer effectiveness per unit of mechanical energy expenditure (see FIGS. 4, 7 and 10).

As best seen in the core sections in FIGS. 5, 6 and 7 and their respective fin cross-sections in FIGS. 8, 9 and 10, the louver groupings 40 occupy the spaced areas A between the sides of the tubes with the total louvered area of the fin surface as explained further later being, at most, less than about twice the remaining unlouvered or plain fin area comprising the intermediate fin area(s) B between the tube rows (FIGS. 5, 8 and 6, 9) and the extended or projecting fin areas C past the tubes to the two ends of the fins. This combination of louvers and plain areas or hybrid fin surface acts to reduce mechanical mixing effort by the louvered areas A intermittently (not continually) tripping the air boundary layer with the resulting or residual fluid turbulence then utilized to avoid significant reduction in the convective heat transfer coefficient over the downstream plain fin area B and/or C.

With the hybrid fins 34 minimizing the pressure drop, the fin density is then increased without substantial pressure drop penalty to increase the heat transfer performance to the desired value while maintaining sufficient air flow in restriction sensitive systems. In either case, the higher mass air flow rates through the core allowed by the reduced flow restrictivity effected by the hybrid fin surface A, B and C provides a higher mean effective T between the air and fin surface since the air temperature will be less affected as the flow rate increases. That is, the air temperature gradient along the air flow path of the fins will be less severe allowing more of the fin surface area to be exposed to the air temperature near the reservoir conditions at the flat sides 32 of the tubes.

Moreover, in the multiple row tube arrangements, the intermediate plain surface area B of the hybrid fin provides an unrestricted heat conductive path between the tube rows to effectively reduce the temperature gradient in the fin. This acts to further improve the heat transfer efficiency since more of the fin surface then approaches the base temperature of the fin thereby effectively increasing the T between the air and the extended fin surface(s) B and/or C.

However, this combination of hybrid fin surface and high fin density was discovered to operate in current automotive application with significantly improved results as compared to a conventional multilouver fin only within certain prescribed limits for the louvered area and density of the hybrid fin as will now be described. To illustrate this phenomenon and in aid of defining such limits, there is reproduced in FIGS. 12–15 the results of tests comparing the hybrid radiators in FIGS. 1–10 with radiators having the conventional multiple louver fin shown in FIG. 11 whose louvers extend over most of the fin surface. In these tests, the radiators compared had substantially identical material content, the same fin edge projection C, the same core depth D, and the same fin density.

As is well known, the tubes and fins in the radiators can be fabricated from a number of materials varying in thermal and structural properties. In particular, the fin material gage (thickness) is typically chosen to provide an adequate combination of fin efficiency for heat transfer performance and strength to resist process and service loads. In testing the hybrid fin against the conventional and through later evaluation, it was discovered that when various hybrid fin geometries were tested in combination with particular materials and gages, the heat transfer and pressure drop relationship was found to be substantially improved in comparison to conventional designs as described in further detail later. However, the hybrid fin performance advantages were also found to diminish as thickness and stack density combinations ranged beyond certain critical values as also described in further detail later. Moreover, it was found that describing only the combined fin gage and stacked density limitations as percentages of open area between the tubes can be misleading because certain combinations of fin density and material gage within the prescribed ranges can be chosen which fall short of conventional fin performance. For example, thick fins with low stacked densities were found which would fall within what was found to be the critical thickness and stacked density range yet improved performance did not result. However, it was then discovered that the length of the air flow facing fin edge per unit area of the air flow space between the tubes may be defined without regard to fin thickness and that this parameter, which I have termed linear fin edge projection density and will also refer to as LFEPD, when determined in conjunction with the other critical values of fin thickness and stacked density and total louvered fin area, more clearly defines the proper but limited realm of hybrid fin that does substantially advance the art. This parameter which is obtained by dividing the length of the fins along their air flow facing edge per unit of area between the tubes by such unit area may be expressed by an equation independent of fin thickness as follows:

$$LFEPD = \frac{TL}{SP(T)} = \frac{L}{SP} \tag{1}$$

where

S=fin height (see FIG. 7)
P=fin pitch (see FIG. 7)
T=fin gage (thickness)
SP=repetitive unit area on which derivation is based
L=length of fin strip edge per SP in plane SP
TL=projection area of fin in plane SP.

Referring to FIG. 7, it is seen that $$L = \frac{2S}{\text{Sin}\left[\text{Tan}^{-1}\frac{2S}{P}\right]}. \tag{2}$$

Substituting Equation (2) for L in Equation (1), the latter can then be expressed as $$LFEPD = \frac{L}{SP} = \frac{1}{SP} \times \frac{2S}{\text{Sin}\left[\text{Tan}^{-1}\frac{2S}{P}\right]} \tag{3}$$

which reduces to $$LFEPD = \frac{2/P}{\text{Sin}\left[\text{Tan}^{-1}\frac{2S}{P}\right]}. \tag{4}$$

Figure 1:
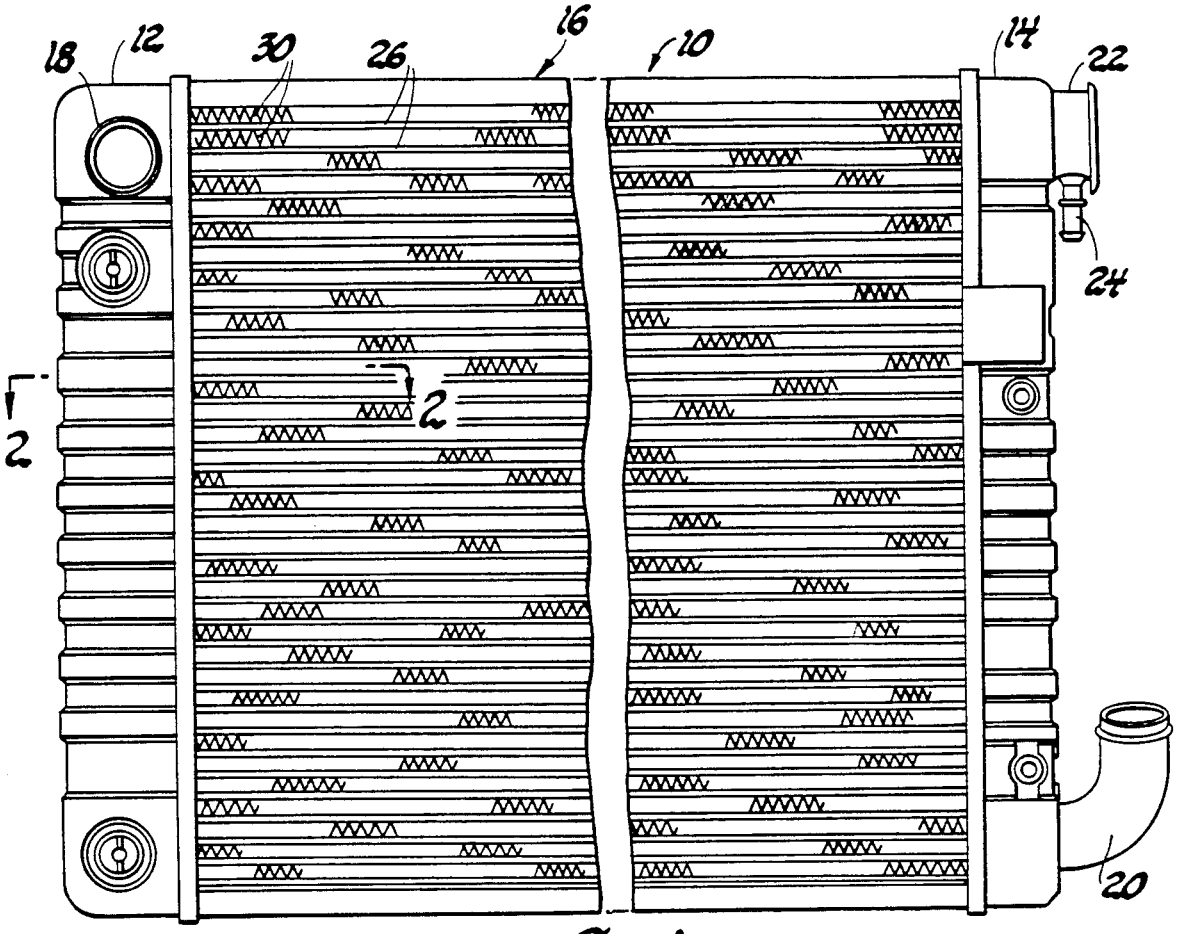
FIG. 1 is a front view of a flat tube and fin radiator for a motor vehicle's engine cooling system wherein the radiator has three rows of flat tubes and there is incorporated therewith one embodiment of the hybrid fin arrangement according to the present invention.
Figure 11:
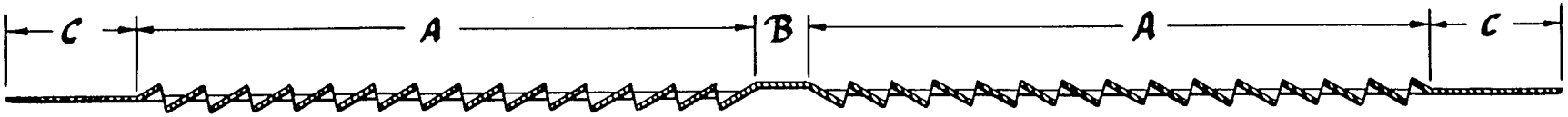
(PRIOR ART) Fig.11
FIG. 11 is a longitudinal sectional view of a conventional multilouver fin.
Figure 12:
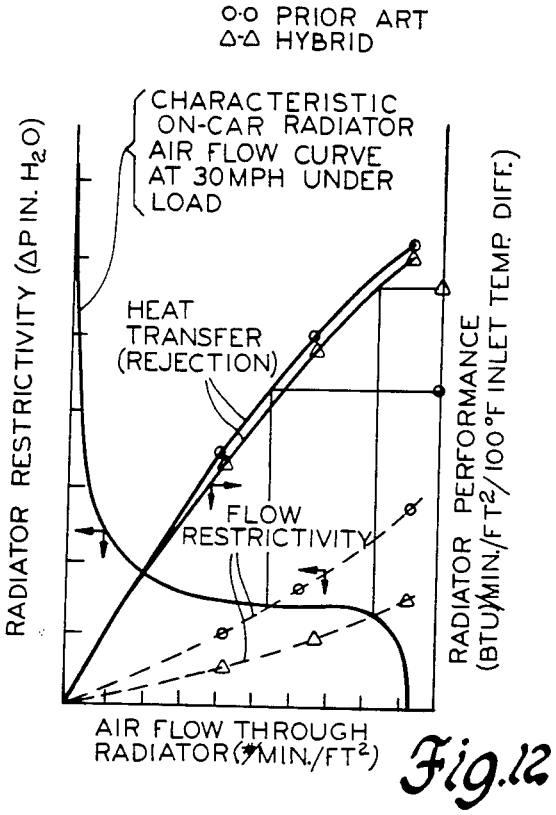
FIGS. 12–15 and 18–20 are graphs of test results comparing on-car performance of radiators having the hybrid fin arrangement of the present invention with a radiator having a conventional multilouver fin arrangement.

Referring first to FIG. 12, there is shown the results of tests with the three-row tube hybrid fin radiator in FIGS. 1, 2 and 8 and a conventional three-row tube radiator having the FIG. 11 multilouver fin. In these radiators, the fin edge projection C was 3.1% of the total fin area and the same, the core depth D was 1.57" and the same, the fin density was twenty (20) fins per inch and the same, but the conventional multilouver fins in FIG. 11 had 88% louvered area whereas the hybrid fins 34 in FIG. 8 had only 43% louvered area. Moreover, these radiators had a certain linear fin edge projection density LFEPD which is defined without regard to fin thickness by the equation $$LFEPD = \frac{2/P}{\text{Sin}\left[\text{Tan}^{-1}\frac{(2/S)}{P}\right]}$$

where S is the fin span and P is the fin pitch, as shown in FIG. 7. In these radiators the LFEPD $=0.81\ \text{mm}^{-1}$ when S and P are measured in millimeters. Comparing only the heat transfer (rejection) curves, it appears that the conventional multilouver fin slightly outperforms the hybrid fin. However, when the respective restrictivity curves are compared relative to the characteristic or typical on-car radiator air flow curve at 30 MPH under load, it is seen that the resulting operating air flows occurring where these curves intersect have the hybrid radiator clearly outperforming the conventional radiator in the vehicle to a substantial degree (i.e. about a 30% increase at this typical air flow condition).

Figure 6:
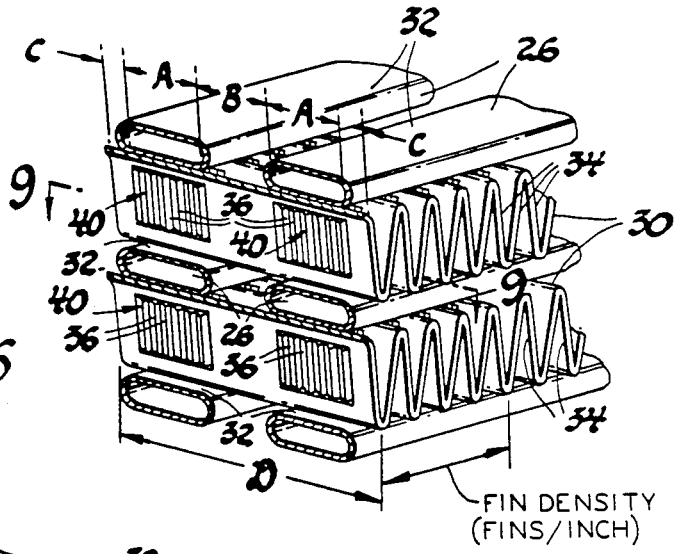
FIG. 6 is an enlarged isometric view of a section of the two row tube radiator core in FIG. 3.
Figure 9:
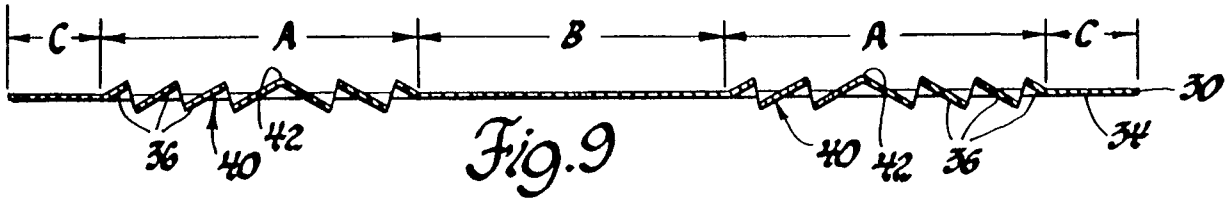
FIG. 9 is an enlarged longitudinal sectional view taken along the line 9—9 through one of the hybrid fins in FIG. 6.
Figure 13:
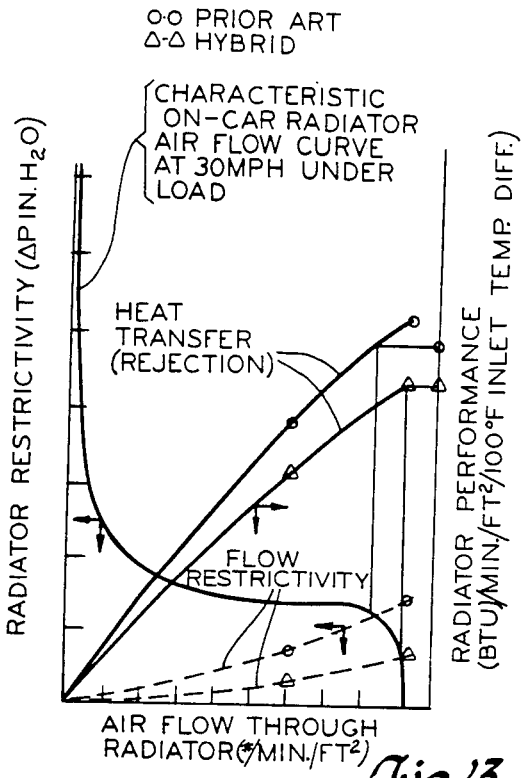

Referring next to FIG. 13, there are shown results of tests with the two-row tube hybrid fin radiator in FIGS. 3, 6 and 9 and a conventional two-row tube radiator having the FIG. 11 multilouver fin. In this case, the fin edge projection C was the same at 2.2%, the core depth D was the same at 0.98", the fin density was the same at seventeen (17) fins per inch, and the linear fin edge projection density LFEPD $=0.58\ mm^{-1}$ when S and P are measured in millimeters but the conventional multilouver fins in FIG. 11 had 78% louvered area whereas the hybrid fins 34 in FIG. 9 had 55% louvered area. As can be seen, the conventional multilouver arrangement again appears to outperform the hybrid. And this is confirmed when their respective restrictivity curves are compared to the characteristic vehicle/radiator air flow curve. What has happened is that at this reduced fin density, there is not sufficient air flow with the hybrid fin to recover the reduced inherent heat transfer so that the conventional multilouver fin then remains the performance leader.

Figure 14:
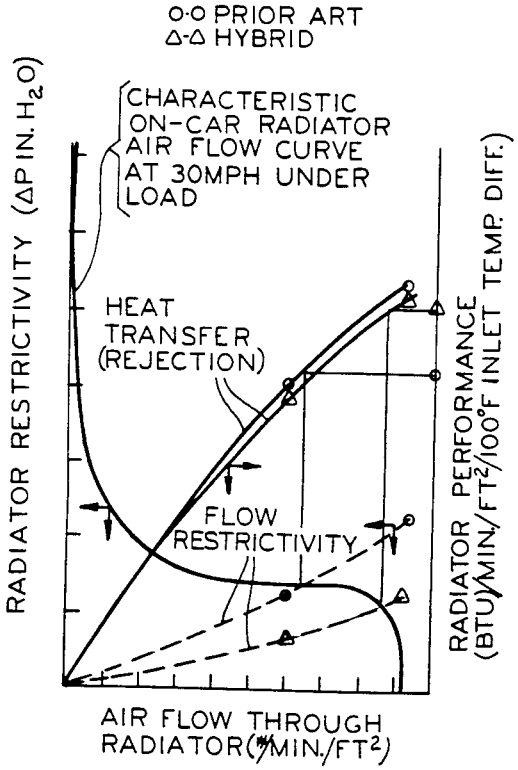

Turning then to FIG. 14, there is shown the results of tests with a two-row tube hybrid radiator and conventional multilouver radiator like previously described but with the fin density increased from seventeen (17) to twenty (20) fins per inch. Again based on the heat transfer curves, the conventional multilouver fin appears to outperform the hybrid fin. But now with the increased fin density, it is seen that the resulting spread in the restrictivity curves and thereby in the operating air flows has the hybrid radiator again clearly outperforming the conventional radiator to a substantial degree (i.e. about a 25% increase).

Figure 15:
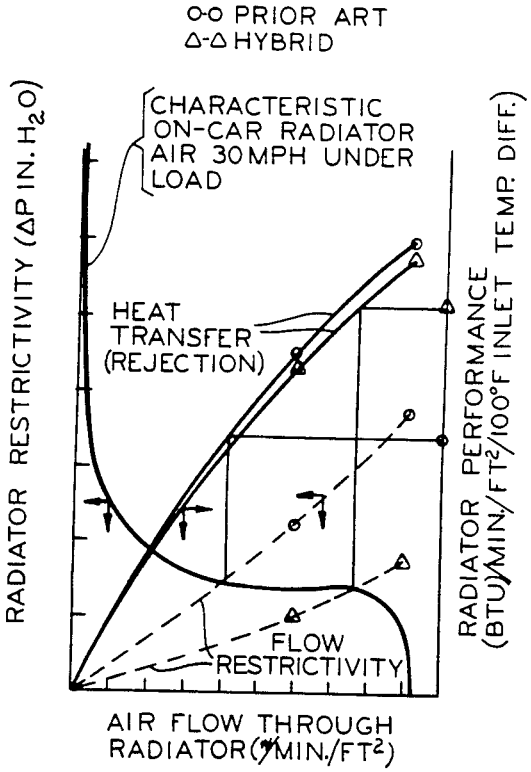

Turning then to FIG. 15, there are shown the results of tests with a two-row tube hybrid radiator and conventional multilouver radiator like previously described but with the fin edge projection C increased from 3.1% to 3.8% and the fin density further increased to twenty-five (25) fins per inch. As can be seen, the same trends identified in FIG. 14 exist in FIG. 15 with the effect of the variation in restrictivity even more pronounced by the increase in fin density and plain surface (increase in the edge projection) in the hybrid fin arrangement. The result is a significant improvement in performance of about 50% provided by the hybrid fin arrangement. And this translates on a vehicle into significantly lower coolant operating temperatures.

Figure 16:
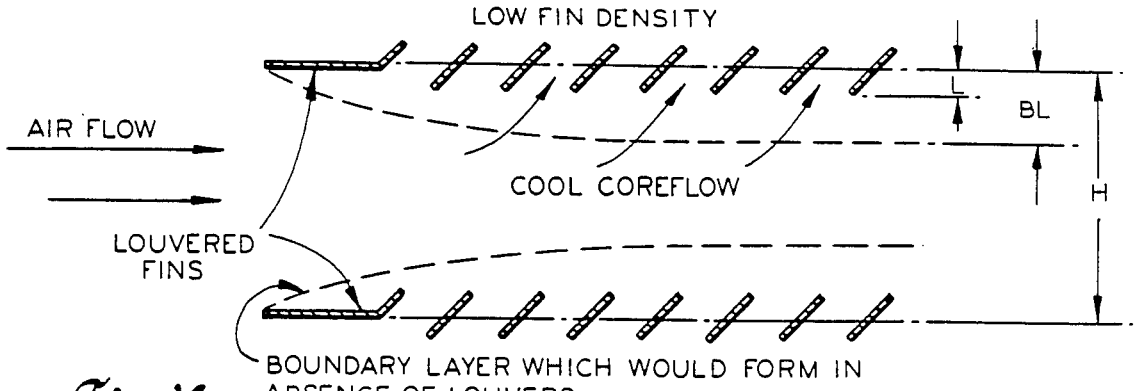
FIGS. 16 and 17 depict the flow phenomena contributing to heat transfer and pressure drop in low and high density louvered fin arrangements respectively.
Figure 17:
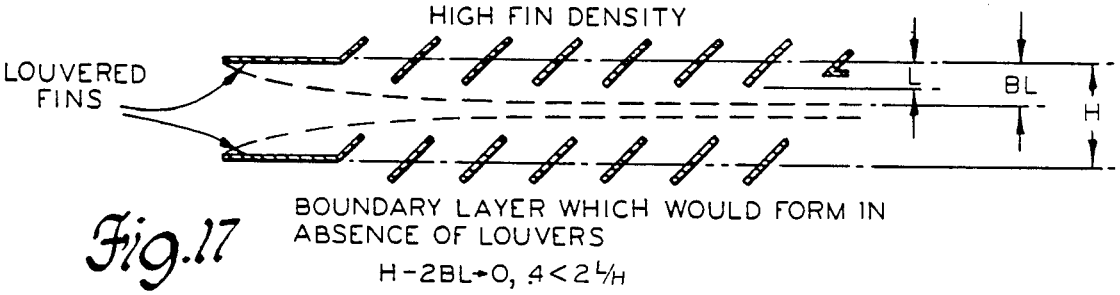

In analyzing this phenomenon, reference is now made to FIGS. 16 and 17 where there is depicted relatively low and high density louvered fin arrangements respectively and those flow phenomena which contribute to heat transfer and pressure drop. In examining same, mechanical energy is consumed when the working fluid (mass) is mixed (accelerated) through a distance, wherein both the acceleration and displacement are vector quantities. Mixing tends to augment heat transfer when the channel height (H) is such that large quantities of "core flow" would otherwise remain thermally insulated from the warm fin. As shown in FIG. 16, thermal isolation becomes evident in configurations where the flow channel height is orders of magnitude larger than the height of a boundary layer (BL) which would form over a plain fin (no louvers) radiator of otherwise equivalent description. With relatively low fin density with louvers, this was found to occur when $H-2(BL)>>BL$ with $0.25<2L/H<0.4$ where L is the louver height extending into the channel. Mixing then results in the warm fin regions being generously bathed by the cooler working fluid (core flow). The hybrid fin of the present invention is targeted for high fin density flow channel height the order of the magnitude shown in FIG. 17 where $H-2(BL)$ nears 0 with $0.4<2L/H$. In these targeted geometries, mixing in a conventionally louvered radiator would require significant mechanical expenditure because a large percentage of fluid flow is directly and continuously affected by consecutive louvers (i.e. the total number of louvers within a given conventionally louvered heat exchanger will increase with fin density and will therefore pose a greater resistance to a given air flow rate). However, heat transfer within the targeted geometries does not benefit as strongly from increased mixing intensity because the availability of thermally isolated core flow is significantly diminished as fin density increases. For example, as fin density increases, the desired return on investment (heat transfer augmentation for invested mechanical mixing effort) diminishes. The hybrid fin of the present invention utilizes improved flowability to generously replenish the cool reservoir fluid bath, and strategically located louvers between the sides of the tubes to add selective turbulence which, along with its residual, acts to discourage thermal gradients in the air flow stream perpendicular to the fin. These two physical mechanisms then combine to reduce pumping power requirements while maintaining impressive heat transfer properties.

Figure 18:
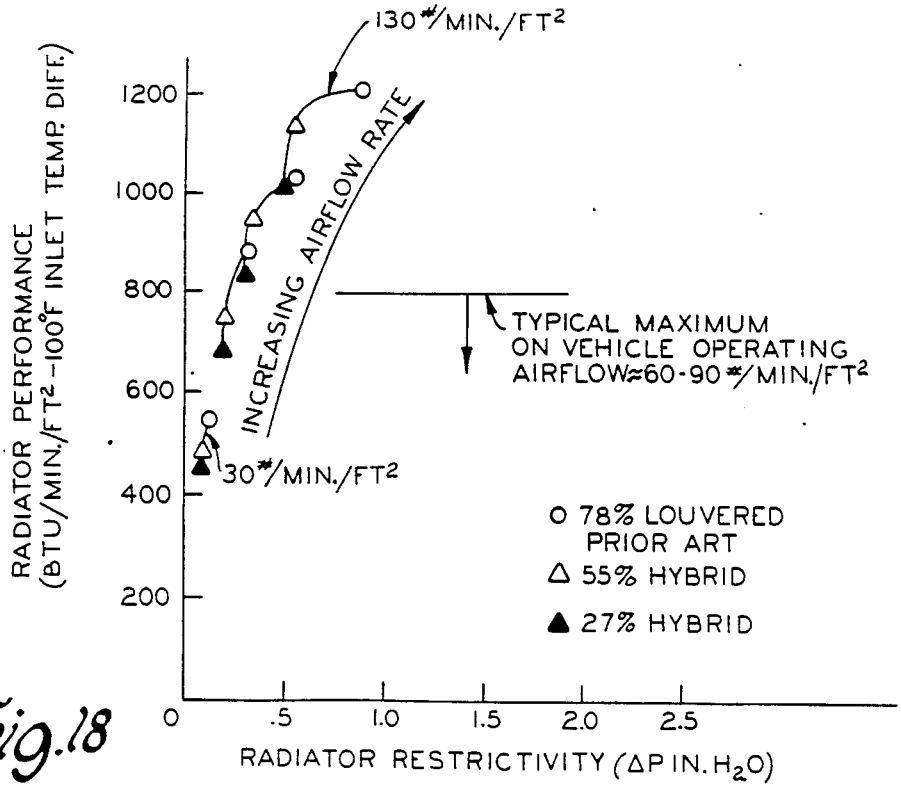
Figure 19:
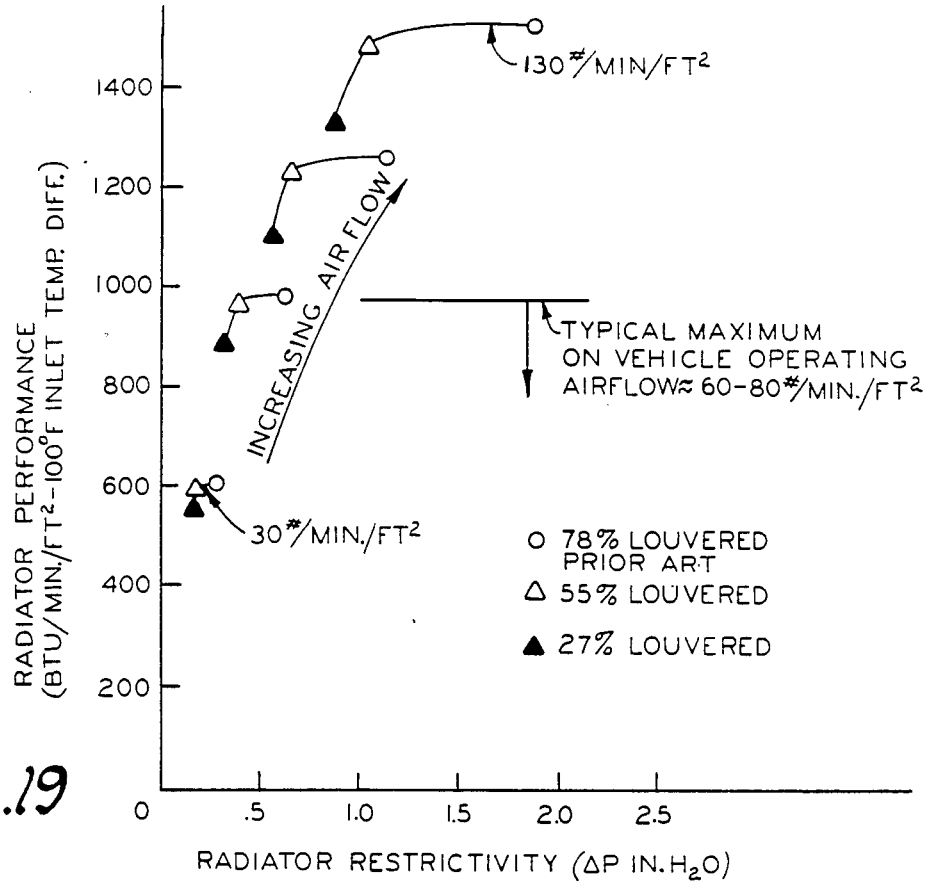

With the above in mind and now referring back, for example, to the comparison made in FIG. 13 for a two-row tube hybrid fin radiator versus conventional where the louvering occupies 78% of the available fin surface, there is shown in FIG. 18 the affect on performance in varying the louvering population from 27% up to the 78% conventional figure. In FIG. 18, the performance data is plotted as heat transfer versus radiator restrictivity to depict the functional relationship between heat transfer improvements and the mechanical energy expenditure required to produce air flow (restrictivity) FIG. 18 shows that at the boundary of the geometry targeted (i.e. fin density at 17 per inch leaving 2.2% available space between the tubes occupied by the fins), and within a region of air flow typical for operating vehicles, a significant improvement in heat transfer accompanies the increase in restrictivity as louvered concentration is increased from 27% to 55%. Consequently, the lower fin densities typically used in the past would appear to benefit from increased louver concentrations. This is not, however, the case as shown by FIG. 19 which is like FIG. 18 but refers back to the FIG. 15 comparison with 25 fins per inch leaving 3.8% available space between the tubes occupied by the fins. FIG. 19 shows that well within the targeted geometries and typical vehicle operating air flows, the heat transfer is improved significantly only until louver concentration reaches a threshold value. Past that threshold louver population, heat transfer improves slowly and restrictivity increases very rapidly. In the performance versus restrictivity curves plotted for varying louver concentrations, the interaction just described appears graphically as a decided "knee". As fin density increases, this knee becomes accentuated at lower air flow rates, and, as shown in FIG. 19 at 25 fins per inch (3.8% fin density) the phenomena of diminishing performance return for added mechanical effort falls to well within the range of typical vehicle operating air flow rates.

Figure 20:
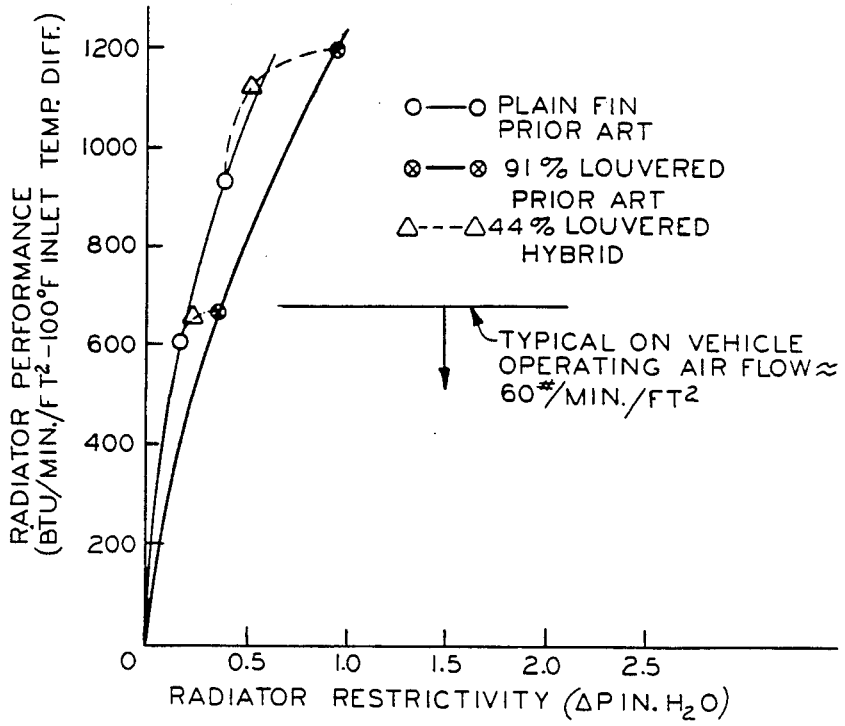

FIG. 20 is produced to further explain the departure from the prior art. Performance versus restrictivity is again plotted but this time comparing a conventional plain fin radiator with 25 fins per inch (10% fin density) and a conventional louver fin radiator with 91% louvering but otherwise identical structure. At low air flow rates, their curves show nearly equal heat transfer performance converging at (0,0). But their performance diverges quickly as mass flow increases. Restrictivity follows the same trend but reflects a considerably more pronounced variation in terms of percentages than does heat transfer. Noting that typical vehicle air flows fall below the line indicated and that in the past, conventionally louvered fin radiators had repeatedly shown air flow related on-car performance deterioration as fin density increased past a threshold, the present invention took the path of interpolating between such prior designs to improve radiator flowability without significantly reducing the heat transfer characteristics. The hybrid fins earlier described are overlayed on FIG. 20 to illustrate that the interpolation process employed when empirically evaluated resulted in advantageously nonlinear trends of significant benefit.

Figure 10:
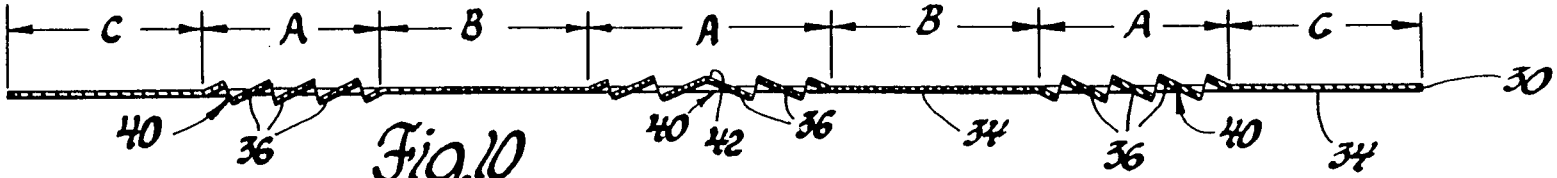
FIG. 10 is an enlarged longitudinal sectional view taken along the line 10—10 through one of the hybrid fins in FIG. 7.

These and other comparisons and tests indicate that the hybrid fin arrangement (including the fin density) within certain limits provides significant improvement in performance in the single-row tube hybrid radiator in FIGS. 4, 7 and 10 as well as the multiple tube row (two and three row) cores previously discussed. In analyzing the most significant characteristics of such hybridization, it was discovered that significantly improved and consistently optimum heat transfer performance occurred when the hybrid fins 34 had a total louvered area A not more than 60% nor less than 40% of the total fin area, a thickness and stacked density such as to constitute not more than 12% nor less than 2.5% of the space between the sides 26 of the tubes and a linear fin edge projection density LFEPD of not more than 1.2 $mm^{-1}$ nor less than 0.68 $mm^{-1}$ when S and P are measured in millimeters.

Furthermore, it was found that within the louvered area A of the hybrid fins there could also then be formed intermediate of the louvers 36 a strengthening beam 42 to strengthen the fins against crushing from external forces and the flat tubes against ballooning from internal forces or pressure and without loss in the performance gain. As shown in FIGS. 8, 9 and 10, the strengthening beam 42 is simply formed as a reversely bent or angular rib extending across each fin amid the louvers between the middle of the opposing flat sides 26 of the tubes. And preferably, such beams are formed as a continuation of the adjacent and thus adjoining louvers as shown.

With such fin hybridization and density, it will be appreciated then that compared to the conventional tube and fin radiator with multilouver fins, the hybrid fin radiator of the present invention allows substantial downsizing along with the other attendant advantages of a smaller core depth with fewer louvers per fin. Furthermore, it will be appreciated that while the embodiments disclosed are those presently preferred as applied to flat tubes, other embodiments will occur to those skilled in the art from the above teaching including application of the hybrid fin to heat exchangers with oval and round tubes.

The embodiments of the invention in which an exclusive property or privilege is claimed are defined as follows:

1. A tube and fin heat exchanger comprising a plurality of tubes arranged in spaced side-by-side relationship, a folded strip forming a plurality of louvered fins arranged in spaced side-by-side relationship and between and in heat transfer relationship with adjacent ones of said tubes, said fins having a thickness and stacked density such as to constitute not more than about 12% nor less than about 2.5% of the space between the adjacent tubes, said fins further having a total louvered area not more than about 60% nor less than about 40% of the total fin area, and said fins having a length along their air flow facing edge per unit of area between the tubes divided by said unit area that as measured in millimeters is not more than about 1.2 $mm^{-1}$ nor less than about 0.68 $mm^{-1}$.

2. A tube and fin heat exchanger comprising a plurality of tubes arranged in spaced side-by-side relationship, a folded strip forming a plurality of louvered fins arranged in spaced side-by-side relationship and between and in heat transfer relationship with adjacent ones of said tubes, said fins having a thickness and stacked density such as to constitute not more than about 12% nor less than about 2.5% of the space between the adjacent tubes, said fins further having a total louvered area not more than about 60% nor less than about 40% of the total fin area completely located directly between the adjacent tubes, and said fins having a length along their air flow facing edge per unit of area between the tubes divided by said unit area that as measured in millimeters is not more than about 1.2 $mm^{-1}$ nor less than about 0.68 $mm^{-1}$.

3. A tube and fin heat exchanger comprising a plurality of flat tubes arranged in spaced side-by-side relationship, a folded strip forming a plurality of louvered fins arranged in spaced side-by-side relationship and between and in heat transfer relationship with adjacent ones of said tubes, said fins having a thickness and stacked density such as to constitute not more than about 12% nor less than about 2.5% of the space between the adjacent tubes, said fins further having a total louvered area not more than about 60% nor less than about 40% of the total fin area, said fins having a length along their air flow facing edge per unit of area between the tubes divided by said unit area that as measured in millimeters is not more than about 1.2 $mm^{-1}$ nor less than about 0.68 $mm^{-1}$, and said fins further having at least one strengthening beam of reverse bent cross-sectional configuration formed integral therewith and extending thereacross between the adjacent flat tubes for strengthening the fins against crushing from external forces and the flat tubes against ballooning from internal forces.

* * * * *